US012643034B2

(12) United States Patent
Huang

(10) Patent No.: US 12,643,034 B2
(45) Date of Patent: Jun. 2, 2026

(54) BUTTON-OPERATED GAME MACHINE

(71) Applicant: Junfan Huang, Shantou (CN)

(72) Inventor: Junfan Huang, Shantou (CN)

( * ) Notice: Subject to any disclaimer, the term of this patent is extended or adjusted under 35 U.S.C. 154(b) by 0 days.

(21) Appl. No.: 19/428,037

(22) Filed: Dec. 19, 2025

(65) Prior Publication Data

US 2026/0115581 A1 Apr. 30, 2026

(30) Foreign Application Priority Data

Nov. 27, 2025 (CN) ..... 202522531104.1

(51) Int. Cl.
*A63F 13/00* (2014.01)
*A63F 9/18* (2006.01)

(52) U.S. Cl.
CPC ..... *A63F 9/183* (2013.01)

(58) Field of Classification Search
None
See application file for complete search history.

(56) References Cited

U.S. PATENT DOCUMENTS 4,285,517 A * 8/1981 Morrison ..... G07F 17/32 463/9
4,309,030 A * 1/1982 Goldfarb ..... A63F 9/24 273/455
4,363,482 A * 12/1982 Goldfarb ..... A63F 9/183 463/9
4,770,416 A * 9/1988 Shimizu ..... A63F 9/24 463/9
5,035,430 A * 7/1991 Suzuki ..... A63F 9/08 273/153 R
5,743,796 A * 4/1998 Orak ..... A63F 3/00094 273/237
8,088,003 B1 * 1/2012 Bickerton ..... A63F 3/00119 463/31
8,579,687 B2 * 11/2013 Neveaux ..... A63F 9/0096 463/7
10,369,457 B2 * 8/2019 Holmes ..... A63F 9/0826
2006/0160594 A1 * 7/2006 Brase ..... G09B 7/02 463/9
2009/0096159 A1 * 4/2009 Kenney ..... A63F 1/06 273/460
2012/0142420 A1 * 6/2012 Huffer ..... A63F 13/24 463/37
2015/0094154 A1 4/2015 Sugiyama
2015/0306495 A1 * 10/2015 Lee ..... A63F 13/24 463/37

(Continued)

*Primary Examiner* — Paul A D'Agostino

(57) ABSTRACT

A button-operated game machine is provided. On the button-operated game machine, when a user presses a button, after the button passes through a clamping portion, the clamping portion is reset under driving of an elastic arm, to block resetting of the button, namely, the button is limited at a position after the pressing. When resetting is required, a reset button is pressed to press an entire elastic rebound seat to rotate through a reset member, so that the elastic rebound seat drives all clamping portions to do reset movement through elastic arms, to deactivate limitation imposed by the clamping portions on buttons. All button-linked resilient arms are released to drive all the buttons to be reset. In this way, all the buttons do not need to be separately provided with reset springs, which effectively reduces production and manufacturing costs.

10 Claims, 9 Drawing Sheets

(56) References Cited

U.S. PATENT DOCUMENTS

| | | | | |
|---|---|---|---|---|
| 2017/0312644 | A1* | 11/2017 | Meir | E04H 4/0056 |
| 2019/0122493 | A1* | 4/2019 | Ikeda | G07F 17/3204 |
| 2020/0246684 | A1* | 8/2020 | Koga | A63F 13/57 |

* cited by examiner

BUTTON-OPERATED GAME MACHINE

TECHNICAL FIELD

The present disclosure relates to the field of toys, and in particular, to a button-operated game machine.

BACKGROUND

A button-operated game machine is usually provided with a plurality of buttons which are operated by users to trigger generation of corresponding electrical signals. However, the existing button-operated game machines still have shortcomings in practical applications:

For example, some button-operated game machines (such as answer rush game machines) are provided with a plurality of answer buttons. Each answer button needs to correspondingly have a spring to achieve self-resetting. That is, each answer button is correspondingly provided with a reset spring. In this way, when there are many answer buttons, the manufacturing costs of the product are too high due to a large quantity of reset springs, and the assembling and production efficiency of the product is low. Meanwhile, it is not convenient to maintain and repair the buttons.

SUMMARY

The present disclosure provides a button-operated game machine which can solve the problems of high manufacturing costs, low assembling and production efficiency, and inconvenience of maintenance and repair.

The present disclosure provides a button-operated game machine, including:

a housing;

a button assembly including a button seat, a plurality of button-linked resilient arms, and a plurality of buttons, wherein the button seat is arranged on the housing; the button-linked resilient arms are respectively arranged on the button seat; the buttons are arranged on the button-linked resilient arms in a one-to-one correspondence manner; the buttons are exposed out of the housing;

an elastic rebound assembly including an elastic rebound seat and a plurality of elastic arms, wherein the elastic rebound seat is movably arranged on the housing; the elastic arms are respectively arranged on the elastic rebound seat; each elastic arm is provided with a clamping portion; the clamping portions are exposed in movement paths of the buttons in a one-to-one correspondence manner; when the buttons overcome elastic forces of the button-linked resilient arms and move, the clamping portions are pressed by the buttons to open the movement paths; the clamping portions are driven to be reset by the elastic arms after being detached from the buttons, to limit the buttons through the clamping portions; and a reset operation assembly including a reset button and a reset member, wherein the reset buttons are slidably arranged on the housing; the reset member is slidably arranged on the housing, and the reset member movably presses the elastic rebound seat; and when the reset button presses the reset member to slide, the reset member presses the elastic rebound seat to rotate, so that the elastic rebound seat drives the clamping portions to be detached from the movement paths through the elastic arms, and then the button-linked resilient arms are released to drive the buttons to be reset.

Preferably, the elastic rebound assembly further includes a rotating reset spring; the elastic rebound seat is rotatably arranged on the housing; and the rotating reset spring is in driving connection to the elastic rebound seat and is configured to provide a force to drive the elastic rebound seat to do reset rotation.

Preferably, a rotating waist hole is formed in the elastic rebound seat; a plugging column is arranged on the housing; a plugging hole is formed in the button seat; the plugging column is threaded into the rotating waist hole and is plugged into the plugging hole; and one end of the rotating reset spring is sleeved on the plugging column, and another end of the rotating reset spring is connected to the elastic rebound seat.

Preferably, a reset waist hole is formed in the reset member; a reset column is arranged inside the housing; the reset column is plugged into the reset waist hole; and the reset column can slide along the reset waist hole.

Preferably, the reset member has a first pressing end and a second pressing end; the reset button movably presses the first pressing end; and the second pressing end movably presses the elastic rebound seat.

Preferably, the reset operation assembly includes an operation reset spring; a pressing column is arranged on the reset button; the operation reset spring is sleeved on the pressing column; and the pressing column movably presses the first pressing end.

Preferably, the button-operated game machine includes four reset operation assemblies; each reset operation assembly includes the reset button and the reset member; the reset buttons are respectively slidably arranged on the housing; the reset members are respectively slidably arranged on the housing; the reset buttons movably press the reset members in a one-to-one correspondence manner; and the reset members respectively movably press the elastic rebound seat.

Preferably, the button-operated game machine further includes a functional assembly including a circuit board, a function switch, and a function button; the circuit board is arranged on the housing; the function switch is arranged on the circuit board; and the function button is slidably arranged on the housing and movably presses the function switch.

Preferably, the functional assembly further includes a sensing element; and the sensing element is electrically connected to the circuit board and is located on a central axis of the housing.

Preferably, the housing is provided with a plurality of avoidance holes; the avoidance holes are uniformly distributed along a circumference around a central axis of the housing; and the buttons are threaded into the avoidance holes in a one-to-one correspondence manner.

The present disclosure has the following beneficial effects:

The present disclosure relates to the button-operated game machine. On the button-operated game machine, when a user presses a button, after the button passes through a clamping portion, the clamping portion is reset under driving of an elastic arm, to block resetting of the button, namely, the button is limited at a position after the pressing. When resetting is required, the reset button is pressed to press the entire elastic rebound seat to rotate through the reset member, so that the elastic rebound seat drives all the clamping portions to do reset movement through the elastic arms, to deactivate limitation imposed by the clamping portions on the buttons. All the button-linked resilient arms are released to drive all the buttons to be reset.

In this way, all the buttons do not need to be separately provided with reset springs, which effectively reduces production and manufacturing costs. During assembling and production, the button seat is aligned and mounted, without assembling a spring for each button, thus improving assembling and production efficiency of a product. Further, during maintenance and repair of the buttons, mounting and removal of springs are also avoided, and convenience of maintenance and repair is improved.

BRIEF DESCRIPTION OF THE DRAWINGS

The exemplary implementations of the present disclosure will be described in more details by combining the accompanying drawings. The above and other objectives, features, and advantages of the present disclosure will become more obvious. In the exemplary implementations of the present disclosure, the same reference numerals generally represent the same components.

DETAILED DESCRIPTION OF THE EMBODIMENTS

Figure 1:
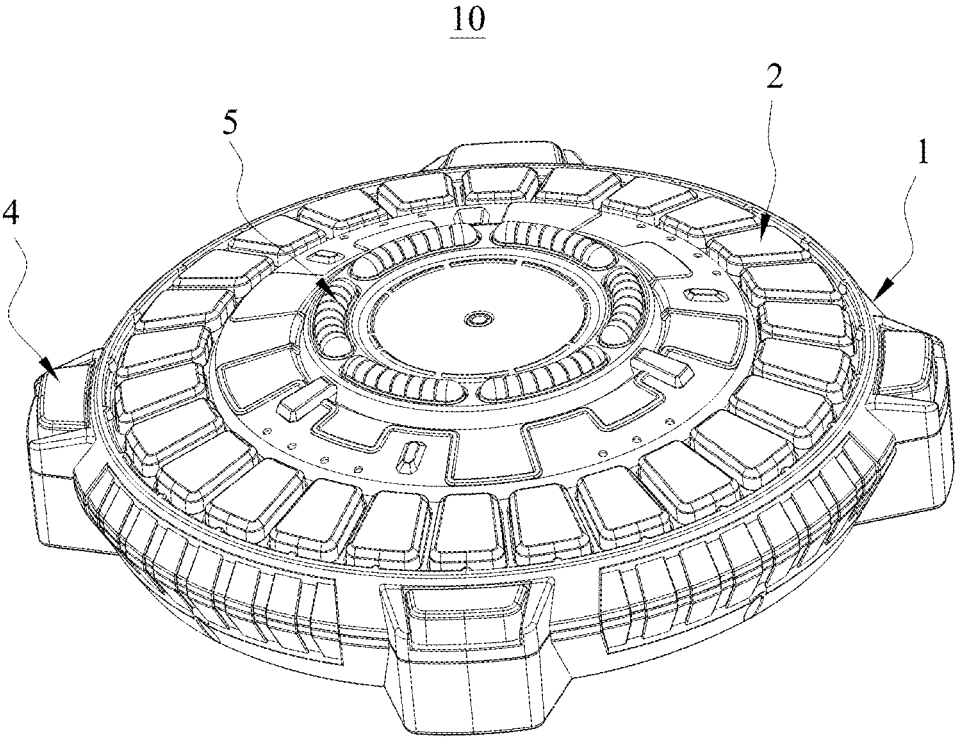
FIG. 1 is a schematic structural diagram of a button-operated game machine in some embodiments of the present disclosure.

The implementations of the present disclosure will be described in more details below with reference to the accompanying drawings. Although the accompanying drawings show the exemplary implementations of the present disclosure, it should be understood that the present disclosure can be implemented in various forms, and should not be limited to the implementations stated herein. Rather, these implementations are provided for understanding the present disclosure more thoroughly and completely, and can completely transfer the scope of the present disclosure to those skilled in the art.

It should be understood that although various information may be described using terms such as "first", "second", and "third" in the present disclosure, such information should not be limited to these terms. These terms are only used to distinguish information of the same type from each other. For example, without departing from the scope of the present disclosure, the first information can also be referred to as the second information, and similarly, the second information can also be referred to as the first information. Thus, features defined as "first" and "second" explicitly or implicitly include one or more of the features. In the description of the present disclosure, "plurality" means two or more, unless otherwise expressly and specifically defined.

In the descriptions of the present disclosure, it should be understood that orientations or positional relationships indicated by the terms "length", "width", "upper", "lower", "front", "rear", "left", "right", "vertical", "horizontal", "top", "bottom", "inner", "outer", and the like are orientations or positional relationships as shown in the drawings, and are only for the purpose of facilitating and simplifying the descriptions of the present disclosure instead of indicating or implying that devices or elements indicated must have particular orientations, and be constructed and operated in the particular orientations, so that these terms are not construed as limiting the present disclosure.

Unless otherwise expressly specified and limited, the terms "mount", "connect", "connection", "fix" the like should be understood in a broad sense, such as, a fixed connection, a detachable connection, an integrated connection, a mechanical connection, an electrical connection, a direct connection, an indirect connection through an intermediate medium, an internal communication of two elements, or interaction between two elements. For those of ordinary skill in the art, the specific meanings of the aforementioned terms in the present disclosure can be understood based on specific conditions.

Figure 2:
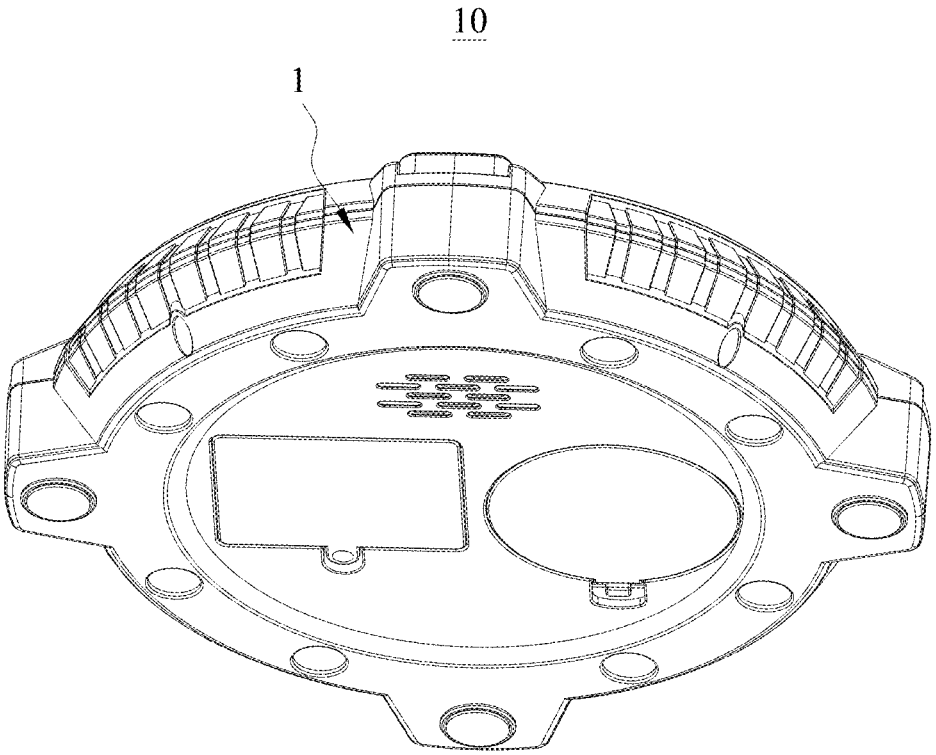
FIG. 2 is a schematic structural diagram of the button-operated game machine shown in FIG. 1, viewed in another angle.
Figure 3:
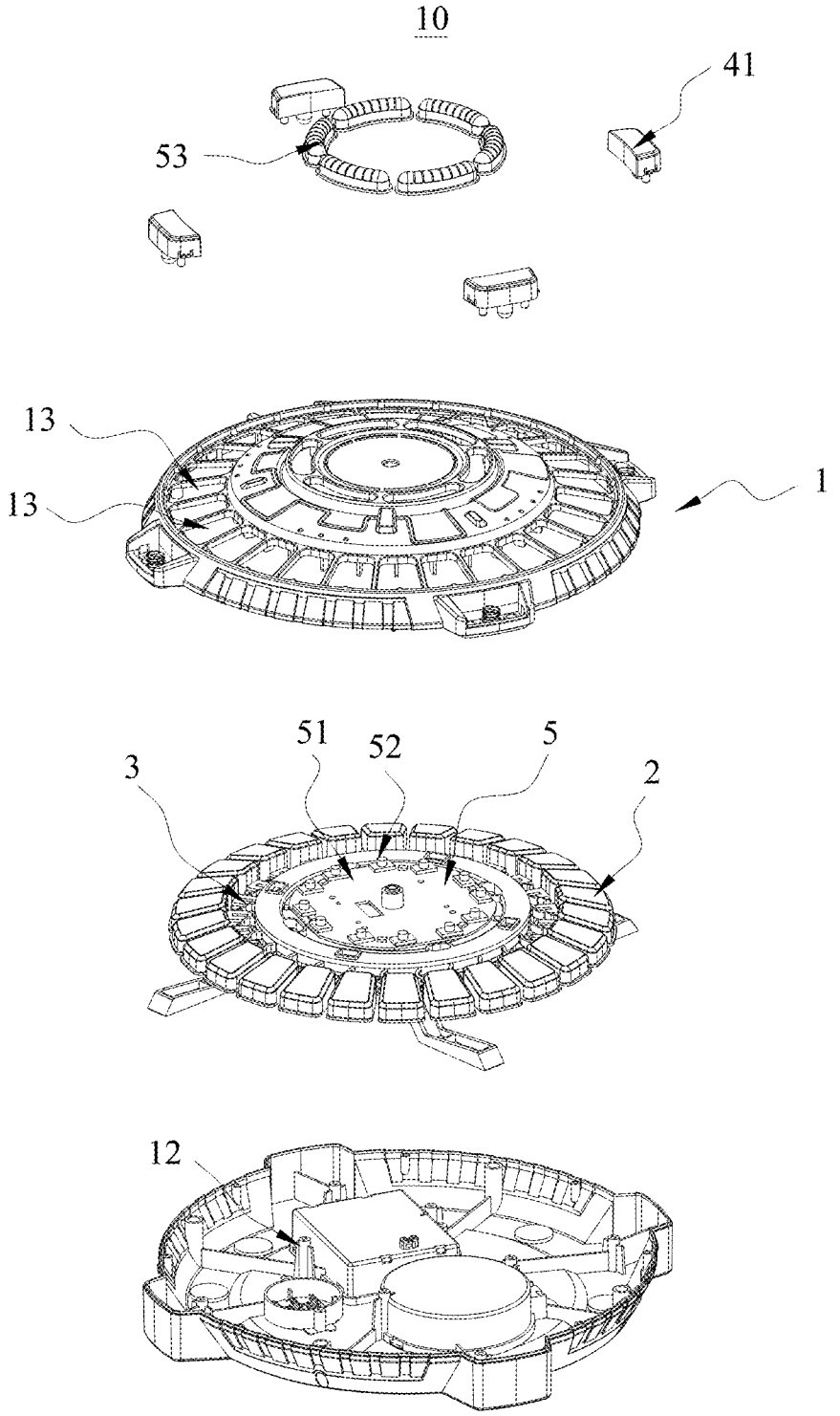
FIG. 3 is an exploded diagram of a button-operated game machine in some embodiments of the present disclosure.
Figure 4:
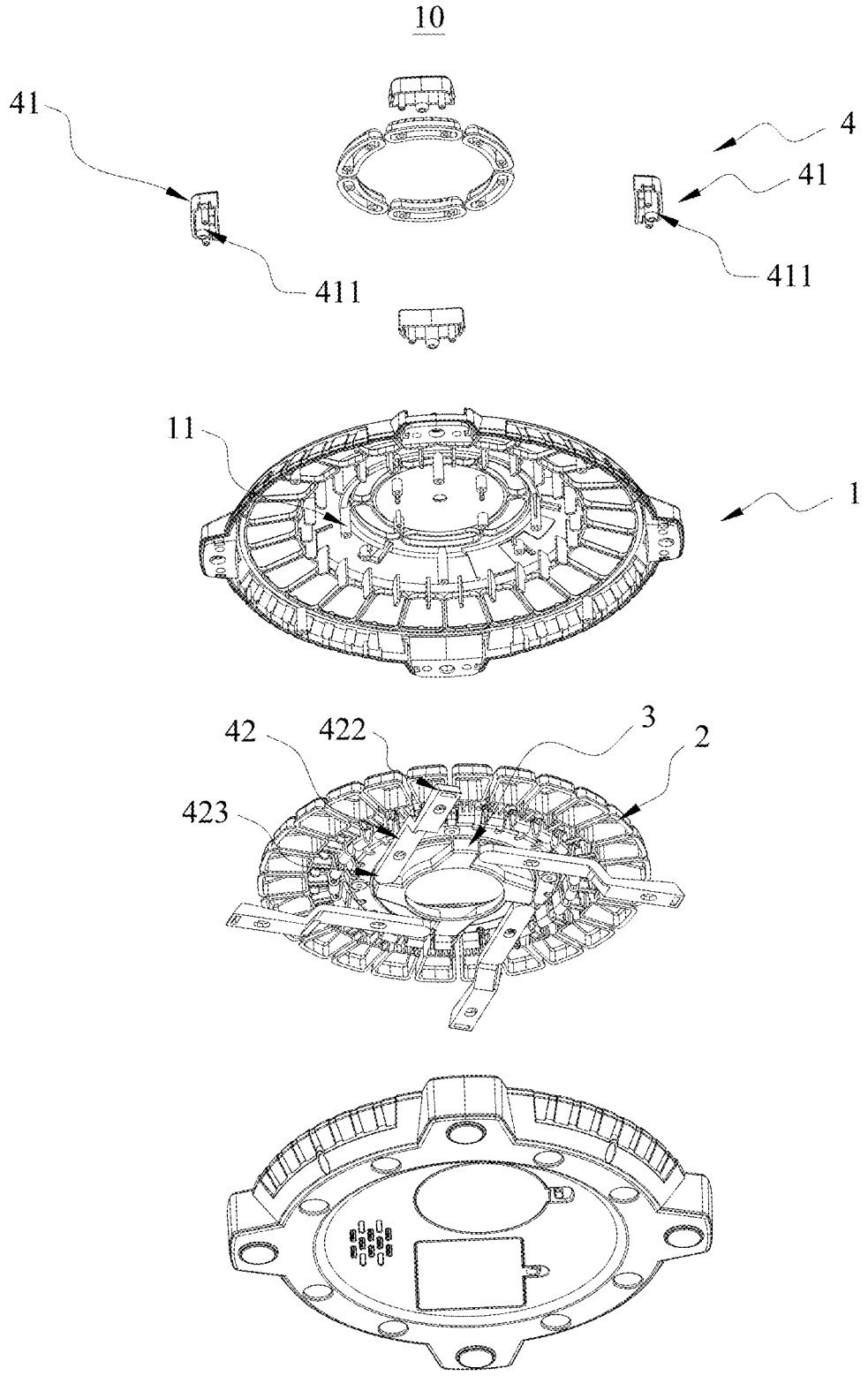
FIG. 4 is an exploded diagram of the button-operated game machine shown in FIG. 3, viewed in another angle.
Figure 5:
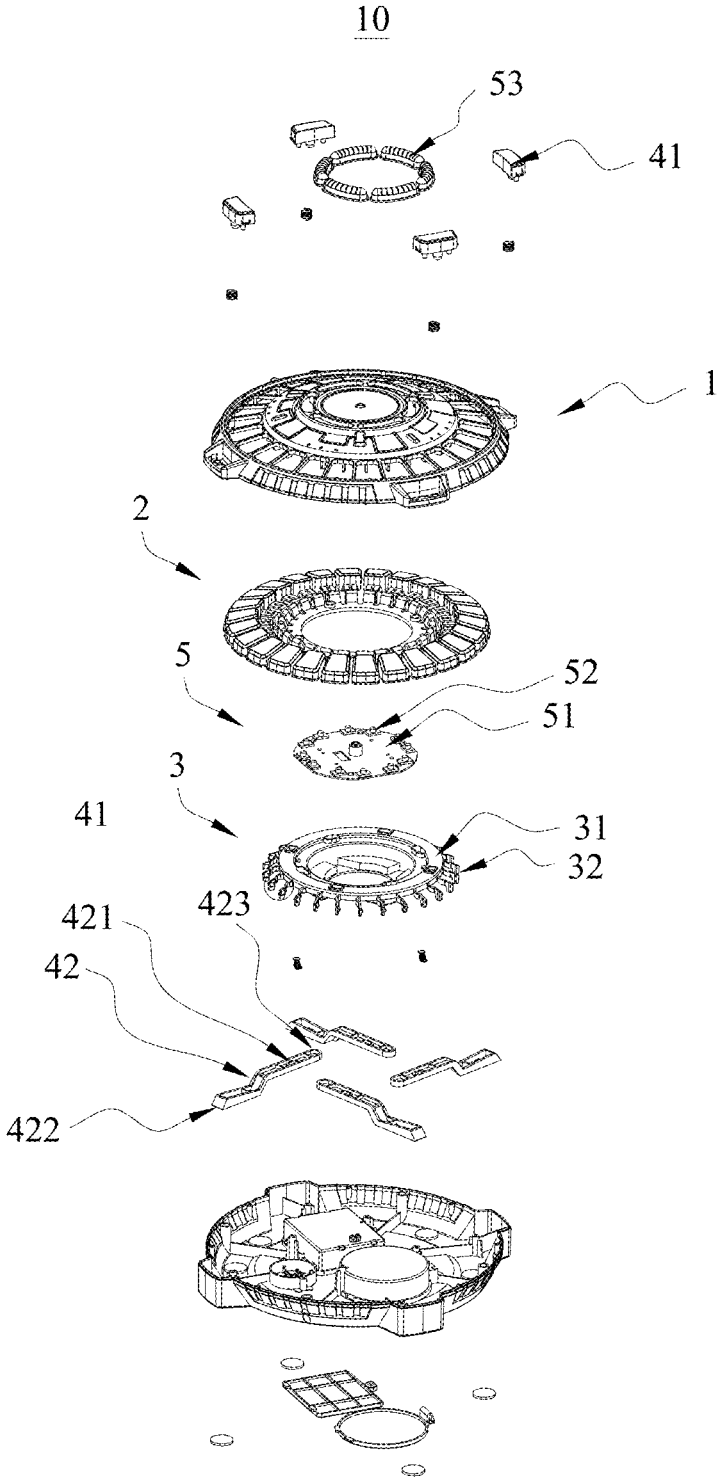
FIG. 5 is another exploded diagram of a button-operated game machine in some embodiments of the present disclosure.
Figure 6:
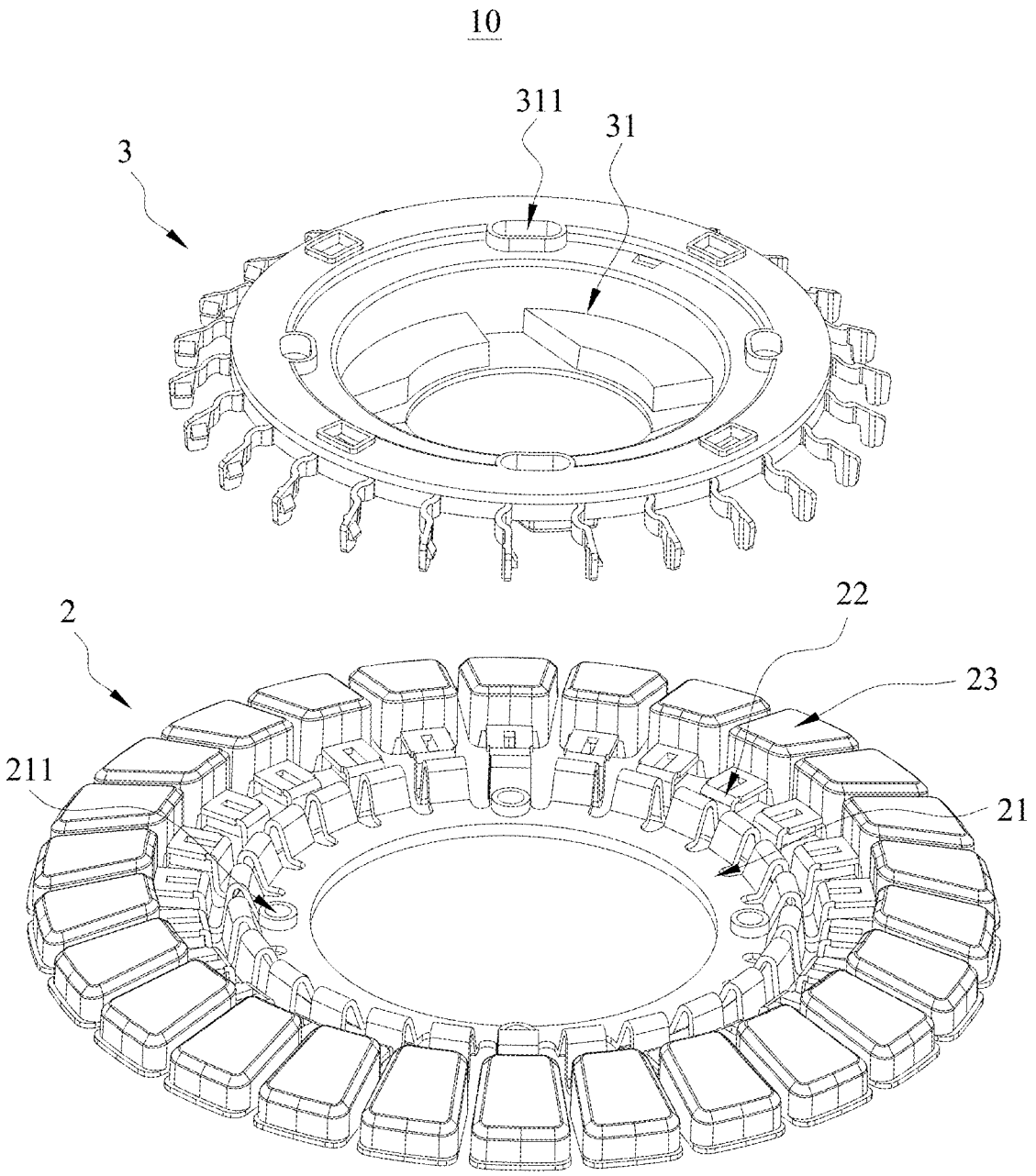
FIG. 6 is a partially schematic structural diagram of a button-operated game machine in some embodiments of the present disclosure.
Figure 7:
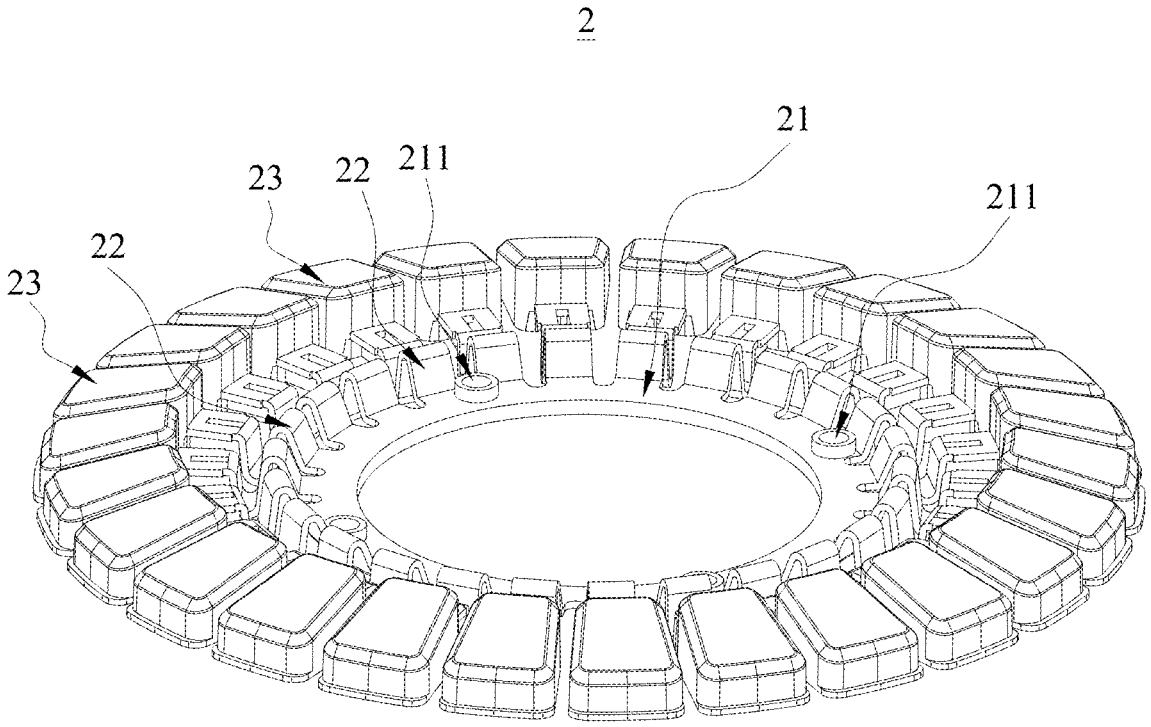
FIG. 7 is a schematic structural diagram of a button assembly in some embodiments of the present disclosure.
Figure 8:
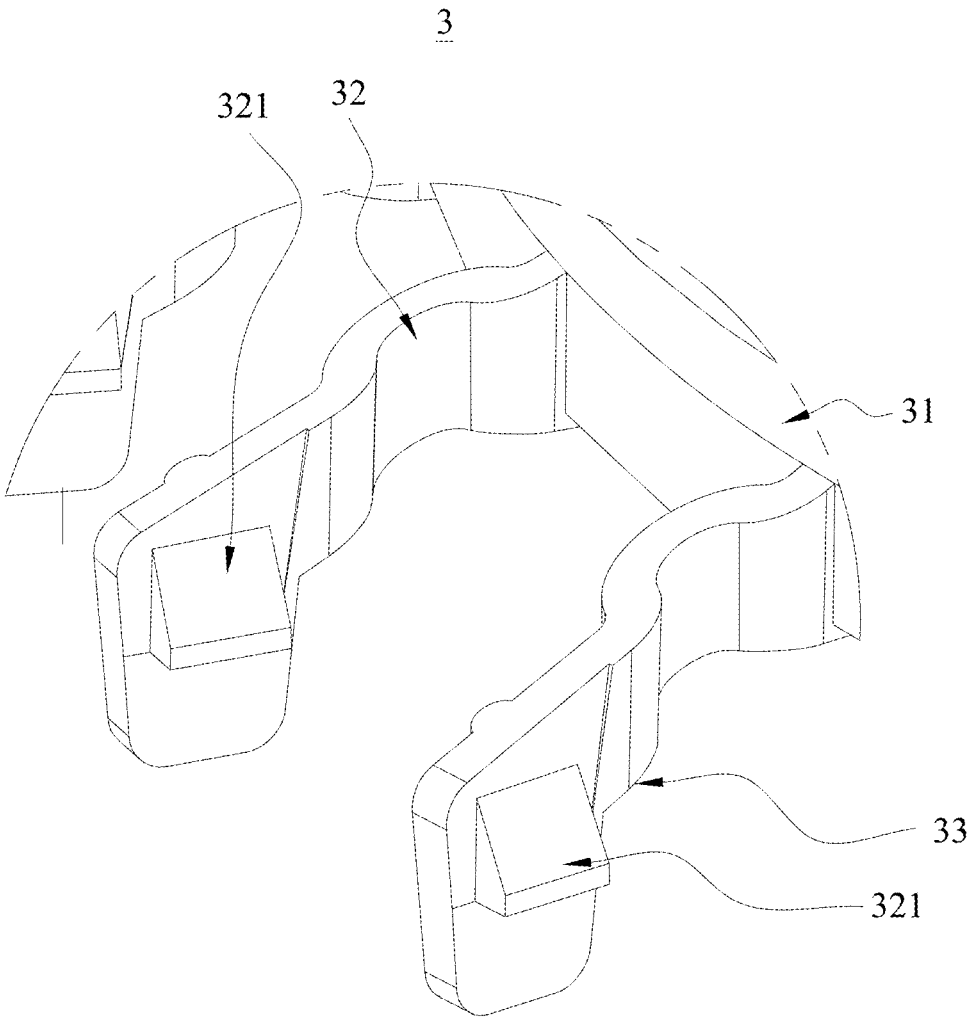
FIG. 8 is a schematic structural diagram of an elastic rebound assembly in some embodiments of the present disclosure.
Figure 9:
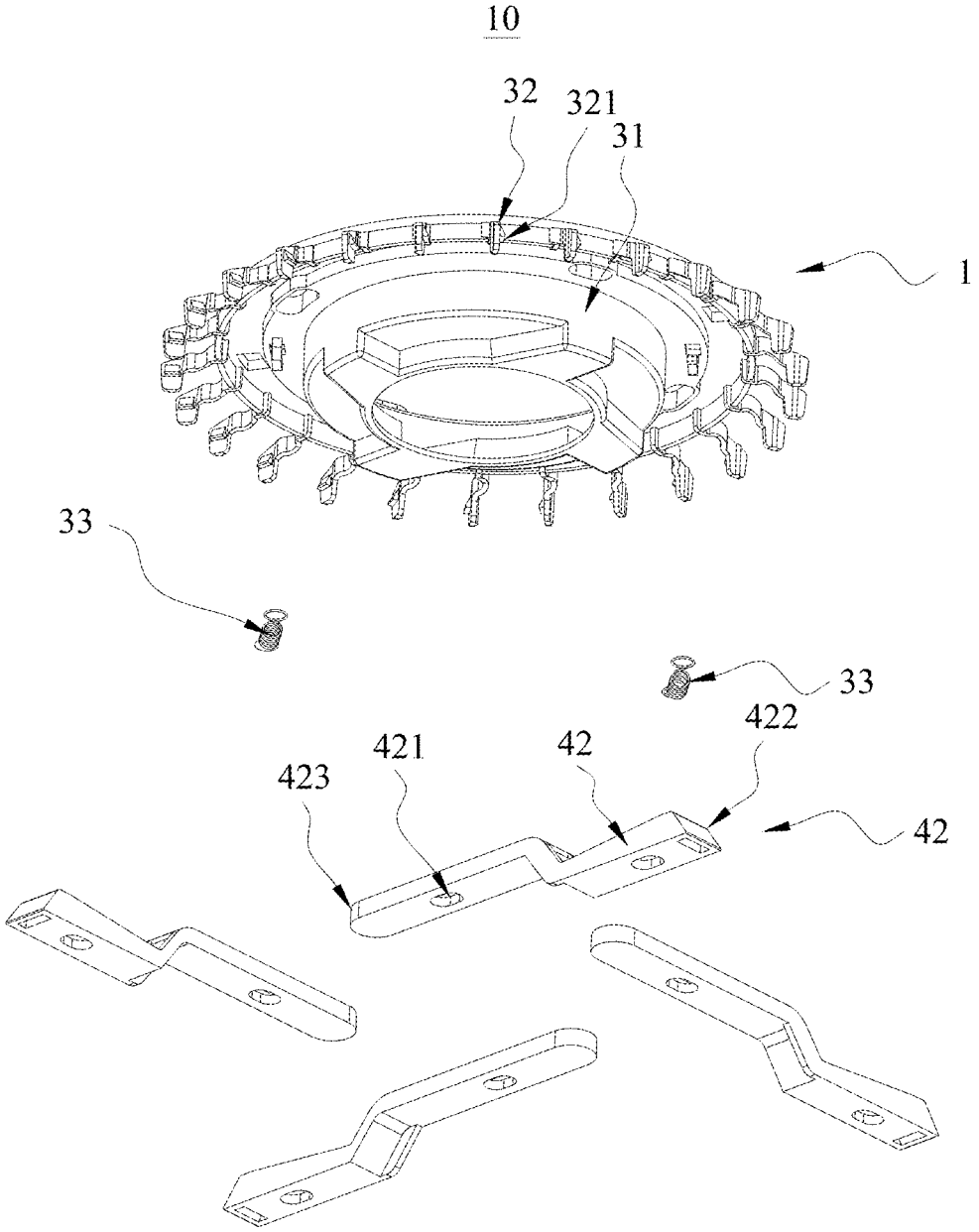
FIG. 9 is another partially schematic structural diagram of an elastic rebound assembly in some embodiments of the present disclosure.

FIG. 1 and FIG. 2 show a button-operated game machine 10 provided by the present disclosure. Referring to FIG. 1 to FIG. 4, the button-operated game machine 10 includes a housing 1, a button assembly 2, an elastic rebound assembly 3, and a reset operation assembly 4. The button assembly 2, the elastic rebound assembly 3, and the reset operation assembly 4 are respectively arranged on the housing 1.

It can be understood that the housing 1 is configured to provide mounting positions for other assemblies and also plays a protective role. The button assembly 2 is configured for being operated by a user. The elastic rebound assembly 3 movably presses the button assembly 2 and is configured to limit the button assembly 2 after the pressing. The reset operation assembly 4 is configured to drive the elastic rebound assembly 3 to rotate through an operation of the user, thereby deactivating the limitation imposed by the elastic rebound assembly 3 on the button assembly 2, so that the button assembly 2 can be quickly reset on its own.

As shown in FIG. 3 to FIG. 9, the button assembly 2 includes a button seat 21, a plurality of button-linked resilient arms 22, and a plurality of buttons 23. The button seat 21 is arranged on the housing 1. The button-linked resilient arms 22 are respectively arranged on the button seat 21. The buttons 23 are arranged on the button-linked resilient arms 22 in a one-to-one correspondence manner. The buttons 23 are exposed out of the housing 1.

The elastic rebound assembly 3 includes an elastic rebound seat 31 and a plurality of elastic arms 32. The elastic rebound seat 31 is movably arranged on the housing 1. The elastic arms 32 are respectively arranged on the elastic rebound seat 31. Each elastic arm 32 is provided with a clamping portion 321. The clamping portions 321 are exposed in movement paths of the buttons 23 in a one-to-one correspondence manner. When the buttons 23 overcome elastic forces of the button-linked resilient arms 22 and move, the clamping portions 321 are pressed by the buttons 23 to open the movement paths. The clamping portions 321 are driven to be reset by the elastic arms 32 after being detached from the buttons 23, to limit the buttons 23 through the clamping portions 321.

The reset operation assembly 4 includes a reset button 41 and a reset member 42. The reset buttons 41 are slidably arranged on the housing 1. The reset member 42 is slidably arranged on the housing 1. The reset member 42 movably presses the elastic rebound seat 31.

When the reset button 41 presses the reset member 42 to slide, the reset member 42 presses the elastic rebound seat 31 to rotate, so that the elastic rebound seat 31 drives the clamping portions 321 to be detached from the movement paths through the elastic arms 32, and then the button-linked resilient arms 22 are released to drive the buttons 23 to be reset.

It can be understood that the button seat 21 is fixedly connected to the housing 1. Each button-linked resilient arm 22 has an elastic force, and its shape can be flexibly set, as long as it has an elastic force required to drive each button 23 to be reset, can support the movement of the button 23 along a predetermined stroke, and has required strength. The buttons 23 are configured to be pressed by the user. The elastic rebound seat 31 is rotatably connected to the housing 1. The plurality of elastic arms 32 have elastic forces. The clamping portions 321 can protrude relative to the elastic arms 32. Each reset button 41 is at least partially exposed out of the housing 1, so as to be pressed by the user. The reset member 42 is linked to the reset button 41 through direct or indirect pressing.

It should be noted that after the user presses a button 23, the button 23 can move along a predetermined movement path. In this process, the potential energy of the button-linked resilient arm 22 gradually increases. During the movement, the button 23 can be in contact with the clamping portion 321. With further movement of the button 23 after the contact, the clamping portion 321 can drive the elastic arm 32 to deform under the pressing of the button, so that the clamping portion 321 provides a space for the button 23 to continue to move. Then, as the button 23 moves further, the button 23 can be separated from the clamping portion 321, so that the elastic arm 32 is released to undergo reset deformation, and then the elastic arm 32 drives the clamping portion 321 to be exposed again in the movement path. In this case, even if the user releases the button 23, the button 23 is limited by the clamping portion 321 that has been reset, so that the button 23 is maintained in the position after the pressing (i.e. a triggering position).

When one or more buttons 23 are limited to the triggering position by the clamping portion 321, the user can reset all the buttons 23 by pressing the reset button 41. Specifically, after the user presses the reset button 41, the reset button 41 can press the reset member 42 to slide, so that the reset member 42 presses the elastic rebound seat 31 to rotate. The elastic rebound seat 31 then drives the elastic arm 32 to rotate together, ultimately causing each clamping portion 321 to move away from the movement path of the button 23. In this way, the position limitation imposed by the clamping portion 321 on the button 23 can be deactivated, and the button-linked resilient arm 23 can be released, so that the button 23 is driven to be reset by the button-linked resilient arm 23.

It should be noted that the button seat 21, the plurality of button-linked resilient arms 22, and the plurality of buttons 23 can be made together in a one-piece molding manner, thereby improving component fitting precision, simplifying assembling procedures of a product, and improving production efficiency. Certainly, they can be made separately and then assembled. The elastic arms 32 can be configured to be manufactured on the elastic rebound seat 31 in the one-piece molding manner or can be configured to be made separately and then assembled.

It should also be noted that the movement path of the button 23 refers to a movement path of the button 23 under the pressing operation of the user and after the user releases the button.

As shown in FIG. 3 to FIG. 9, in some embodiments of the button-operated game machine 10, the elastic rebound assembly 3 further includes a rotating reset spring 33. The elastic rebound seat 31 is rotatably arranged on the housing 1. The rotating reset spring 33 is in driving connection to the elastic rebound seat 31 and is configured to provide a force to drive the elastic rebound seat 31 to do reset rotation.

It can be understood that the rotating reset spring 33 is in driving connection to the elastic rebound seat 31 and is configured to provide a reverse reset torque after the elastic rebound seat 31 is driven to rotate by the reset member 42, thus forcing the elastic rebound seat 31 to automatically return to its initial position and preparing for another operation on a subsequent button 23.

It should be noted that due to an elastic reset force of the rotating reset spring 33, it is ensured that the elastic rebound seat 31 is accurately reset after a reset operation is completed, thus avoiding the impact of inertia offset of the clamping portion 321 on reliability of limitation on the subsequent button 23.

As shown in FIG. 3 to FIG. 9, in some embodiments of the button-operated game machine 10, a rotating waist hole 311 is formed in the elastic rebound seat 31. A plugging column 11 is arranged on the housing 1. A plugging hole 211 is formed in the button seat 21. The plugging column 11 is threaded into the rotating waist hole 311 and is plugged into the plugging hole 211.

One end of the rotating reset spring 33 is sleeved on the plugging column 11, and another end of the rotating reset spring 33 is connected to the elastic rebound seat 31.

It can be understood that the rotating waist hole 31 is configured to accommodate the plugging column 11 and limit a rotation stroke range of the elastic rebound seat 31. The plugging column 11 is threaded in the rotating waist hole 311 and plugged into the plugging hole 211 of the button seat 21, thereby jointly limiting a rotation range of the elastic rebound seat 31 with the plugging column 11. The rotating reset spring 33 is configured to transmit an elastic force to the elastic rebound seat 31 through the fixation of the plugging column 11.

It should be noted that through the content of this embodiment, it can be ensured that the elastic rebound seat 31 rotates around a predetermined center and rotates within a predetermined angle range, thereby ensuring accurate resetting of the button 23.

As shown in FIG. 3 to FIG. 9, in some embodiments of the button-operated game machine 10, a reset waist hole 421 is formed in the reset member 42. A reset column 12 is arranged inside the housing 1. The reset column 12 is plugged into the reset waist hole 421. The reset column 12 can slide along the reset waist hole 421.

As shown in FIG. 3 to FIG. 9, in some embodiments of the button-operated game machine 10, the reset member 42 has a first pressing end 422 and a second pressing end 423. The reset button 41 movably presses the first pressing end 422. The second pressing end 423 movably presses the elastic rebound seat 31.

It can be understood that the reset waist hole 421 is configured to accommodate the reset column 12 and limit a sliding path of the reset member 42. The reset column 12 is configured to guide the reset member 42 to slide along a predetermined linear trajectory.

It should be noted that the reset column 12 and the reset waist hole 421 form a linear guidance to ensure that the reset member 42 only moves in a single direction, thus avoiding interference with the rotation of the elastic rebound seat 31 due to deflection. A length of the reset waist hole 421 limits a sliding stroke of the reset member 42 to prevent damage to the elastic rebound assembly 3 because of excessive displacement.

As shown in FIG. 3 to FIG. 9, in some embodiments of the button-operated game machine 10, the reset operation assembly 4 includes an operation reset spring 43. A pressing column 411 is arranged on the reset button 41. The operation reset spring 43 is sleeved on the pressing column 411. The pressing column 411 movably presses the first pressing end 422.

It can be understood that the operation reset spring 43 is configured to provide a reverse elastic force after the reset button 41 is pressed, to drive the reset button 41 to be automatically reset to an initial position. The pressing column 411 is arranged on the reset button 41 and movably presses the first pressing end 422 of the reset member 42 to intensively transmit an operation force to the reset member 42.

It should be noted that the operation reset spring 43 ensures that the reset button 41 automatically rebounds after being pressed, thus improving continuity of operation. The arrangement of the pressing column 411 can reduce friction loss and improve durability.

As shown in FIG. 3 to FIG. 9, in some embodiments of the button-operated game machine 10, the button-operated game machine 10 includes four reset operation assemblies 4. Each reset operation assembly 4 includes the reset button 41 and the reset member 42. The reset buttons 41 are respectively slidably arranged on the housing 1. The reset members 42 are respectively slidably arranged on the housing 1. The reset buttons 41 movably press the reset members 42 in a one-to-one correspondence manner. The reset members 42 respectively movably press the elastic rebound seat 31.

It can be understood that each of the four reset operation assemblies 4 independently includes the reset button 41 and the reset member 42 which are respectively slidably arranged at different positions on the housing 1. The reset buttons 41 movably press the reset members 42 in the one-to-one correspondence manner, to receive user operation instructions in different zones. In a multi-user scenario, convenience of use can be improved. The reset members 42 respectively movably press the elastic rebound seat 31 to drive the elastic rebound seat 31 to rotate in different zones.

As shown in FIG. 3 to FIG. 9, in some embodiments of the button-operated game machine 10, the button-operated game machine 10 further includes a functional assembly 5 including a circuit board 51, a function switch 52, and a function button 53. The circuit board 51 is arranged on the housing 1. The function switch 52 is arranged on the circuit board 51. The function button 53 is slidably arranged on the housing 1 and movably presses the function switch 52.

It can be understood that the circuit board 51 is configured to integrate an electronic element and a signal processing circuit. The function switch 52 is configured to convert a mechanical action into an electrical signal. The function button 53 is slidably arranged on the housing 1 and movably presses the function switch 52 to trigger the function switch 52 to move under an operation of a user.

It should be noted that the arrangement of the functional assembly 5 enriches operational functions of the product, so that more functions can be added in the product. Certainly, there is no limitation on control of a specific function. Any structure that uses the content of this embodiment to achieve functional control shall fall within the protection scope of the present disclosure.

In some embodiments of the button-operated game machine 10, the functional assembly 5 further includes a sensing element. The sensing element is electrically connected to the circuit board 51 and is located on a central axis of the housing 1.

It can be understood that the sensing element can be configured as a near field communication (NFC) sensing element, and different structures that can be sensed by the NCF sensing element are correspondingly arranged on different cards. Further, different NFC sensing structures are arranged on different cards, so that the product can form different button operation requirements or operation rules based on different cards.

In some other embodiments, the sensing element can be configured as a magnetic encoding recognition element, and a magnetic sheet or a magnetic coating can be arranged on a card. In this way, when the card is placed or inserted in a corresponding way or is plugged, the product can recognize different cards and obtain a current operation rule. The operation rule can be flexibly set. For example, after the card is placed in a predetermined position, a current button that needs to be operated can be obtained.

In some other implementations, the sensing element may be configured as an optical recognition element. Correspondingly, a corresponding recognition pattern is arranged on a card. In this way, during actual use of the product, a user can correspondingly place the card, so that the optical recognition element can correspondingly recognize the pattern on the card, and obtain a current operation rule, that is, a current correct button.

As shown in FIG. 3 to FIG. 9, in some embodiments of the button-operated game machine 10, the housing 1 is provided with a plurality of avoidance holes 13. The avoidance holes 13 are uniformly distributed along a circumference around a central axis of the housing 1. The buttons 23 are threaded into the avoidance holes 13 in a one-to-one correspondence manner.

It can be understood that the avoidance holes 13 are configured to precisely limit movement trajectories and stroke ranges of the buttons 23. The buttons 23 can be constrained and guided by hole walls of the avoidance holes 13 during the movement, thereby ensuring stability of user operation feedback and avoiding a failure of the operation feedback caused by movement offset of the buttons 23.

The button-operated game machine of the present disclosure can be flexibly configured with different operation modes based on a design structure, a preset internal program, a usage requirement, and the like in practical applications. In different operation modes, the product can be correspondingly configured with different feedback and different button operation requirements (similar to correct answer buttons).

For mode switching, this configuration can be used: a recognition region is provided in a center of a top of the housing. After different recognized objects are placed in the recognition region, the product is switched to corresponding operation modes. Specifically, shapes of the recognized objects can be flexibly configured. For example, the recognized objects are configured to be card-shaped, circular, square, or in various shapes. Further, the recognized object can be recognized by using a radio frequency recognition (RFID) recognition structure, an NFC recognition structure, a chip insertion structure, or various structures in the existing art. Correspondingly, a corresponding recognition structure is arranged on the housing. Certainly, mode switching can also be performed through the buttons that have already been arranged on the product.

Further, the button-operated game machine of the present disclosure can be at least configured to have the following operation modes:

A first mode is a random mode. A short press is made on a switch button, and then a selection button is pressed to select a corresponding number of players. Each player independently corresponds to one color. After the number of people is determined, a recognized object (such as a card or an object in another shape) is placed in the recognition region in the center of the top of the housing, and a game is triggered to start. Subsequently, a light-emitting diode (LED) can flash in a corresponding color, and a player corresponding to the flashing color needs to answer a question within corresponding time (a user can answer a question by pressing a button). If the answer is correct, the player can press one of the buttons 23 (the buttons 23 can be distinguished by color, number, letter, or other markers) on the outer ring (to indicate that the answer is correct), thus forming a record of a pressed state of the button 23. On the contrary, if the player does not answer correctly or answers incorrectly within 10 seconds, the button-operated game machine can provide corresponding feedback through sound and/or light. Subsequently, another card can be selected again and placed into the machine to continue the game.

A second mode is a buzzer mode, in which a recognized object is placed in the recognition region in the center of the top of the housing, to trigger the game machine to start a game. When a player thinks of a corresponding answer on the card, the player quickly clicks a center button (such as the function button 53) to start to answer the question. The center button can flash for 10 seconds. After the question is answered within 10 seconds, the button can flash again to continue the game. If the question is not answered or is answered incorrectly within 10 seconds, the machine reports a failure, and the card is placed into the machine again to trigger the game machine to start the game again.

A third mode is a timing mode, in which a card is placed in the recognition region in the center of the top of the housing to trigger the game machine to start a game. Each player has 10 seconds to answer the question. After answering the question, the player quickly presses the center button (such as the function button 53). A countdown of 10 seconds starts again for the turn of a next player. If the question is not answered or is answered incorrectly within 10 seconds, the machine reports a failure, and the card is placed into the machine again to trigger the game machine to start the game again.

The present disclosure has the following beneficial effects:

The present disclosure relates to the button-operated game machine. On the button-operated game machine, when a user presses a button, after the button passes through a clamping portion, the clamping portion is reset under driving of an elastic arm, to block resetting of the button, namely, the button is limited at a position after the pressing. When resetting is required, the reset button is pressed to press the entire elastic rebound seat to rotate through the reset member, so that the elastic rebound seat drives all the clamping portions to do reset movement through the elastic arms, to deactivate limitation imposed by the clamping portions on the buttons. All the button-linked resilient arms are released to drive all the buttons to be reset.

In this way, all the buttons do not need to be separately provided with reset springs, which effectively reduces production and manufacturing costs. During assembling and production, the button seat is aligned and mounted, without assembling a spring for each button, thus improving assembling and production efficiency of a product. Further, during maintenance and repair of the buttons, mounting and removal of springs are also avoided, and convenience of maintenance and repair is improved.

The solutions of the present disclosure have been described in more details above with reference to the accompanying drawings. In the foregoing embodiments, the description of each embodiment has respective focuses. For a part that is not described in detail in an embodiment, reference may be made to related descriptions in other embodiments. Those skilled in the art should also be aware that the actions and modules involved in this specification may not be necessary for the present disclosure. Furthermore, it can be understood that the steps in the method of the embodiments of the present disclosure can be sequentially adjusted, merged, and deleted according to actual needs. The modules in the device of the embodiments of the present disclosure can be merged, partitioned, and deleted according to actual needs.

The above has described the various embodiments of the present disclosure. The above explanation is exemplary, not exhaustive, and is not limited to the various embodiments disclosed herein. Many modifications and changes are obvious to those of ordinary skill in the art without deviating from the scope and spirit of the various embodiments described herein. The selection of the terms used herein aims to best explain the principles and practical applications of the various embodiments or improvements to technologies in the market, or to enable other persons of ordinary skill in the art to understand the various embodiments disclosed herein.

What is claimed is:

1. A button-operated game machine, comprising:

a housing;

a button assembly comprising a button seat, a plurality of button-linked resilient arms, and a plurality of buttons, wherein the button seat is arranged on the housing; the button-linked resilient arms are respectively arranged on the button seat; the buttons are arranged on the button-linked resilient arms in a one-to-one correspondence manner; the buttons are exposed out of the housing;

an elastic rebound assembly comprising an elastic rebound seat and a plurality of elastic arms, wherein the elastic rebound seat is movably arranged on the housing; the elastic arms are respectively arranged on the elastic rebound seat; each elastic arm is provided with a clamping portion; the clamping portions are exposed in movement paths of the buttons in a one-to-one correspondence manner; when the buttons overcome elastic forces of the button-linked resilient arms and move, the clamping portions are pressed by the buttons to open the movement paths; the clamping portions are driven to be reset by the elastic arms after being detached from the buttons, to limit the buttons through the clamping portions; and a reset operation assembly comprising a reset button and a reset member, wherein the reset buttons are slidably arranged on the housing; the reset member is slidably arranged on the housing, and the reset member movably presses the elastic rebound seat; and when the reset button presses the reset member to slide, the reset member presses the elastic rebound seat to rotate, so that the elastic rebound seat drives the clamping portions to be detached from the movement paths through the elastic arms, and then the button-linked resilient arms are released to drive the buttons to be reset.

2. The button-operated game machine according to claim 1, wherein the elastic rebound assembly further comprises a rotating reset spring; the elastic rebound seat is rotatably arranged on the housing; and the rotating reset spring is in driving connection to the elastic rebound seat and is configured to provide a force to drive the elastic rebound seat to do reset rotation.

3. The button-operated game machine according to claim 2, wherein a rotating waist hole is formed in the elastic rebound seat; a plugging column is arranged on the housing; a plugging hole is formed in the button seat; the plugging column is threaded into the rotating waist hole and is plugged into the plugging hole; and one end of the rotating reset spring is sleeved on the plugging column, and another end of the rotating reset spring is connected to the elastic rebound seat.

4. The button-operated game machine according to claim 1, wherein a reset waist hole is formed in the reset member; a reset column is arranged inside the housing; the reset column is plugged into the reset waist hole; and the reset column slides along the reset waist hole.

5. The button-operated game machine according to claim 4, wherein the reset member has a first pressing end and a second pressing end; the reset button movably presses the first pressing end; and the second pressing end movably presses the elastic rebound seat.

6. The button-operated game machine according to claim 5, wherein the reset operation assembly comprises an operation reset spring; a pressing column is arranged on the reset button; the operation reset spring is sleeved on the pressing column; and the pressing column movably presses the first pressing end.

7. The button-operated game machine according to claim 1, wherein the button-operated game machine comprises four reset operation assemblies; each reset operation assembly comprises the reset button and the reset member; the reset buttons are respectively slidably arranged on the housing; the reset members are respectively slidably arranged on the housing; the reset buttons movably press the reset members in a one-to-one correspondence manner; and the reset members respectively movably press the elastic rebound seat.

8. The button-operated game machine according to claim 1, wherein the button-operated game machine further comprises a functional assembly comprising a circuit board, a function switch, and a function button; the circuit board is arranged on the housing; the function switch is arranged on the circuit board; and the function button is slidably arranged on the housing and movably presses the function switch.

9. The button-operated game machine according to claim 8, wherein the functional assembly further comprises a sensing element; and the sensing element is electrically connected to the circuit board and is located on a central axis of the housing.

10. The button-operated game machine according to claim 1, wherein the housing is provided with a plurality of avoidance holes; the avoidance holes are uniformly distributed along a circumference around a central axis of the housing; and the buttons are threaded into the avoidance holes in a one-to-one correspondence manner.

* * * * *